US006698721B2

(12) United States Patent
Martin

(10) Patent No.: US 6,698,721 B2
(45) Date of Patent: Mar. 2, 2004

(54) SHOCK-ABSORBING CARPET KICKER

(76) Inventor: John H. Martin, 5530 Owensmouth Ave., #118, Woodland Hills, CA (US) 91367-7023

( * ) Notice: Subject to any disclaimer, the term of this patent is extended or adjusted under 35 U.S.C. 154(b) by 0 days.

(21) Appl. No.: 10/010,035

(22) Filed: Dec. 6, 2001

(65) Prior Publication Data

US 2003/0107028 A1 Jun. 12, 2003

(51) Int. Cl.[7] ..... B25B 25/00
(52) U.S. Cl. ..... 254/201; 254/200
(58) Field of Search ..... 254/200, 201; 294/8.6; 267/177, 221, 64.11–64.28

(56) References Cited

U.S. PATENT DOCUMENTS

| | | | | |
|---|---|---|---|---|
| 425,137 | A | | 4/1890 | Ludlow |
| 1,333,835 | A | | 3/1920 | Coffman |
| 3,322,209 | A | | 5/1967 | Cavanaugh |
| 3,572,800 | A | | 3/1971 | Graziano |
| 3,866,964 | A | | 2/1975 | Prater |
| 3,917,225 | A | | 11/1975 | Payson |
| 3,951,382 | A | | 4/1976 | Asbury |
| 3,977,651 | A | | 8/1976 | Chamberlain |
| 4,126,302 | A | | 11/1978 | Curnutt |
| 4,361,311 | A | | 11/1982 | Koroyasu et al. |
| 4,627,653 | A | | 12/1986 | Koroyasu |
| 4,711,435 | A | | 12/1987 | Harris et al. |
| 5,044,614 | A | * | 9/1991 | Rau ..... 267/221 |
| 5,169,131 | A | | 12/1992 | Shimura |
| 5,255,894 | A | | 10/1993 | Guarneri |
| 5,598,904 | A | | 2/1997 | Spyche, Jr. |
| 5,803,443 | A | * | 9/1998 | Chang ..... 267/221 |
| 5,938,182 | A | | 8/1999 | Goodrich et al. |

* cited by examiner

*Primary Examiner*—Kathy Matecki
*Assistant Examiner*—Evan H Langdon
(74) *Attorney, Agent, or Firm*—O'Melveny & Myers LLP

(57) ABSTRACT

A shock-absorbing carpet kicker for positioning and stretching carpet is disclosed. The carpet kicker includes an engaging head with forwardly-inclined pins for engaging carpet materials on a floor, a shaft connected to the engaging head and extending therefrom, a cushioned pad facing away from the engaging head and connected to the shaft a distance away from the engaging head, and a shock-absorbing device connected to the shaft and interposed between the engaging head and the cushioned pad. The shock-absorbing device comprises a resilient member preloaded against a collapsible tension member, whereby kicks to the cushioned pad are transmitted through the shock-absorbing device to the engaging head. The preloaded tension member permits a portion of the energy of each kick to be transmitted directly to the engaging head, while the resilient member absorbs excess energy of the kick. In an embodiment of the invention, the shock-absorbing device is a modular unit comprising a coil compression spring disposed over the outside of a gas damping cylinder. The compression spring is compressed between opposing ends of the cylinder by an amount that may be adjusted by turning an adjustment knob, permitting a user to tune the response of the carpet kicker for different conditions.

20 Claims, 4 Drawing Sheets

SHOCK-ABSORBING CARPET KICKER

BACKGROUND OF THE INVENTION

1. Field of the Invention

The present invention relates to tools for positioning and stretching carpet in the installation of wall-to-wall carpeting, and more particularly to a portable, impact-operated positioning and stretching tool.

2. Description of Related Art

In the installation of wall-to-wall carpeting, the carpet material is often attached to the floor to be covered around the periphery of the floor area, such as adjacent to the walls of a room. Thin, narrow strips of wood or like material having a plurality of sharp tacks protruding therefrom, referred to as "tack strips", are typically fastened to the periphery of the floor for this purpose. The carpet material is then temporarily attached to the tack strips along one edge of the floor area, stretched across the floor, and attached to the tack strips along an opposite edge of the floor area. The process is repeated with any remaining unattached edges of the carpet, until the carpet has been positioned and stretched as desired. The carpet may then be more permanently attached to the floor by flattening the tacks in the tack strip using a suitable hammering or flattening tool.

Various tools are used in the construction trade for stretching and positioning carpet onto the tack strips. One type of tool is exemplified by the relatively large, lever-activated stretching tools referred to as "power stretchers." Power stretchers typically comprise an extensible tube with a leveraged extension mechanism, a carpet engaging head at a first end of the tube, and a suitable pressure plate at the other end of the tube. The pressure plate is placed against a wall or other suitable stationary structure, and the tube is placed along the carpet material in the desired direction of stretch. The engaging head is engaged with the carpet, and the tube is extended a desired amount using the lever mechanism. As their name suggests, power stretchers are particularly useful for imparting a large amount of stretch to carpet. However, they are relatively large and may not be suitable for odd-shaped floor areas or for working in tight spaces.

Another popular type of tool in the trade is exemplified by the portable, impact-operated stretching and positioning tools referred to as "kickers." Kickers typically comprise a relatively short extendable shaft (less than three feet, and more typically, about eighteen inches long) with a carpet engaging head on one end and a cushioned pad on the opposite end. Kickers are operated by impacting the cushioned pad while the engaging head is engaged in the carpet. An installer typically kneels astride the kicker and impacts the cushioned pad using the thigh and/or knee of one leg, while positioning the engaging head between strokes as desired. Using a kicker, a skilled installer can very quickly work around the periphery of a room or other area to be carpeted, sliding and/or stretching the carpet and fastening it to the tack strips. Being relatively small and versatile, kickers are especially preferred for use in tight spaces, with odd-shaped carpet areas, or for finishing work.

Although kickers remain an essential and popular tool of the trade, excessive or improper use of a kicker may lead to fatigue, back pain, or even back injury. If a kicker is struck too hard by a user's knee, or is not positioned properly on the carpet, the shock of the blow may not be fully absorbed by the carpet that is being positioned by the kicker, and instead, a substantial portion of the shock may be absorbed by the user's body. Over time, repeated use of a kicker may therefore cause or contribute to muscle or joint pain in users who use a kicker frequently, especially those who operate kickers using hard and forceful kicks. Discomfort and injury may be prevented by minimizing kicker use (for example, by using power stretchers instead of kickers whenever possible) and avoiding kicking a kicker harder than is needed to position the carpet. Despite these potential problems, however, many users prefer the speed and convenience of kickers over alternative methods. Many users also find it difficult to attenuate the force of their kicks so they are not overpowering the kicker.

One solution to the problems of shock loading associated with kickers is to provide a kicker that absorbs excessive shock from a kick, i.e., shock that is not absorbed by the carpet itself. Prior art attempts to provide kickers that absorbed the shock of user's kicks have proven unsatisfactory, and have not been widely adopted by the trade. Instead, the vast majority of those in the trade use kickers without any shock-absorbing device, except for a cushioned striking pad that is relatively firm and provides a minimal amount of shock absorption. The limitations of prior-art shock-absorbing kickers are as follows.

In one prior-art, spring-cushioned kicker, the kicker shaft is configured in two parts, a tubular portion, and a solid, piston-like portion slideably engaged in the tubular portion. A coil compression spring is housed within a tubular portion of the kicker shaft, and disposed against the sliding shaft. The force of a kick is transmitted through and partially absorbed by the compression spring. However, this design suffers from several disadvantages. A compression spring that is "soft" enough to absorb substantial shock energy from a user's kick, i.e., a spring with a low enough spring constant "k," will also dramatically reduce the peak force delivered by the kicker to the carpet. The user will therefore expend a great deal of energy compressing the spring, and relatively little energy from the kicking stroke is available for moving the carpet. On the other hand, if a stiffer spring is used, the shock-absorbing property of the kicker is essentially lost. The stiffness of the spring is not adjustable, so even if a spring of optimal stiffness is used, the kicker is not uniformly useful with different types of carpets and for different users.

In another prior-art kicker, the function of the coil compression spring is performed by a sealed air cylinder that functioned as a gas spring. The length of the kicker connecting shaft is adjusted by increasing or decreasing the amount of air in the cylinder, which is therefore at atmospheric pressure when the kicker is at rest. When kicked, the air cylinder functions essentially like the compression spring of the spring-cushioned kicker, that is, to absorb the shock of impact and transmit the kicking force to the engaging head of the kicker. Therefore, the air-cushioned kicker suffers from the same disadvantages of the spring-cushioned kicker: the spring will absorb too much of the force of each kick, making the kicker harder to use, and the effective spring constant (stiffness) of the air cylinder is not adjustable.

It is desired, therefore, to provide a shock-absorbing carpet kicker that overcomes the limitations of prior-art shock-absorbing kickers. The shock-absorbing kicker should be affordable, easy to use, and should not present any significant disadvantages with respect to an ordinary kicker, while helping to prevent injuries associated with excessive or improper use of conventional kickers.

SUMMARY OF THE INVENTION

The present invention provides a shock-absorbing carpet kicker that overcomes the limitations of prior-art kickers.

The kicker of the invention may be constructed cost-effectively, and may be made as versatile and easy to use as carpet kickers that are in use today. At the same time, the kicker is expected to substantially reduce shock and stress on the user, and enhance users' comfort during use.

The carpet kicker may comprise many elements in common with conventional kickers. A structure including a carpet-engaging head connected to a cushioned impact pad via an adjustable shaft may be used, such as may be found in conventional kickers. In addition, a pre-loaded shock-absorbing device is interposed between the cushioned impact pad and the engaging head, at any suitable location along the adjustable connecting shaft. The shock-absorbing device is connected to the other structural elements of the kicker so as to transmit and/or absorb substantially all of (preferably, all of) the energy of each kick by the user. That is, the portion of the energy of each kick that is not absorbed by the shock-absorbing device is substantially transmitted (and preferably, entirely transmitted) to the engaging head.

The shock-absorbing device has a specific configuration, as follows. Conceptually, the shock absorber comprises a resilient member, such as a mechanical spring, configured to absorb energy from a blow to the cushioned pad directed towards the engagement head. The resilient member is mounted in parallel to, and preloaded against, a collapsible tension member. For example, the resilient member may be a compression spring, although other types of springs may also be used, such as a tension spring, provided the other elements of the shock-absorbing device are suitably rearranged. Furthermore, the resilient member is not limited to mechanical springs, but other resilient devices, such as gas springs, may also be used. The collapsible tension member is a mechanism or device, such as a flexible cable, a piston/cylinder assembly, or a mechanical linkage, that is relatively strong and rigid when fully extended under a tension load, and which will collapse under a relatively low compressive load.

The resilient member is pre-loaded against the collapsible member, maintaining it in tension when the kicker is at rest. Because of the pre-load, the resilient member will not immediately compress under the compressive force of the kick. Instead, the shock-absorbing device will remain rigid until the pre-load force is exceeded by the force of the kick. Therefore, most of the initial energy of the kick will be transmitted to the engaging head. Only if and after the force of the kick exceeds a certain level will substantial energy be absorbed by the resilient member.

The amount of pre-load is preferably adjustable by the user of the kicker, such as by turning an adjustment knob on the connecting shaft. An adjustment knob, or other suitable mechanism, may operate by moving the resilient member relative to the collapsible tension member. Preload may be increased by moving the resilient member so as to increase the compression of the resilient member, and decreased by movement in an opposite direction. Such adjustability provides users with the ability to tune the response of the kicker for use with different types of carpets and for individual users' kicking styles.

Advantageously, the collapsible tension member may be a damping device, such as a gas cylinder configured for damping motion. The damping qualities of such a device provide the additional advantage of reducing the backlash of the resilient member. In addition, a damping device may also absorb excess energy during compression of the resilient member, thereby reducing energy dissipation and heating of the resilient member. The damping qualities of a damping device for use in the kicker may also be adjustable by users, such as through adjustment of a gas bleed valve. A damping adjustment may provide users with another way to adjust the dynamic response of the kicker for various use conditions. The damping device may be configured to provide two-way damping (damping in both directions of the cylinder stroke) or one way damping (damping in a single stroke direction and undamped in the opposite direction).

In an embodiment of the invention, the shock-absorbing device comprises a coil compression spring disposed on the outside of a cylindrical gas damping device. The coil spring is compressed between an adjustment knob on the cylinder housing and a retention washer on the piston shaft near an opposite end of the damping device. The coil spring thereby causes the piston of the damping device to be fully extended when at rest. The adjustment knob is threaded onto the cylinder housing, whereby the extent of preload of the coil spring may be adjusted by turning the knob. The shock-absorbing device is preferably a relatively small modular unit that may readily be mounted in-line with the connecting shaft of a conventional kicker. Thus, a kicker may be constructed according the invention at an affordable cost.

A more complete understanding of the shock-absorbing carpet kicker will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a shock-absorbing carpet kicker that overcomes the limitations of prior-art kickers.

The kicker is expected to substantially reduce shock and stress on the user, and enhance users' comfort during use. In the detailed description that follows, like element numerals are used to indicate like elements appearing in one or more of the figures.

Figure 1:
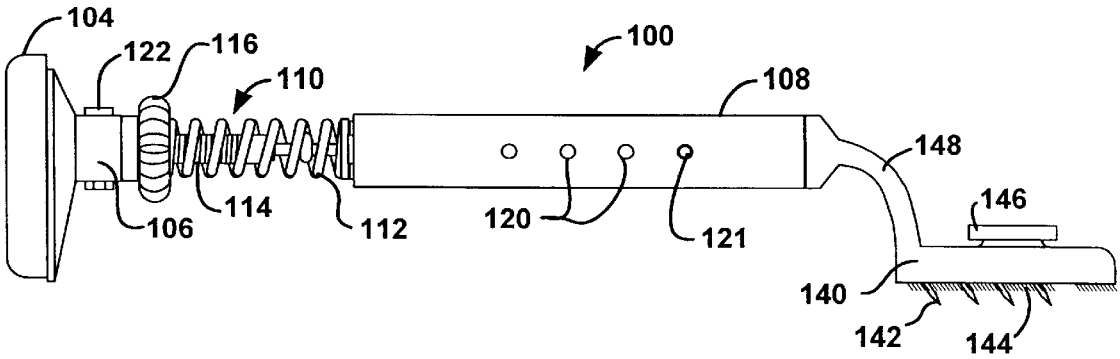
FIG. 1 is a side view of an exemplary shock-absorbing kicker according to the invention.
Figure 2:
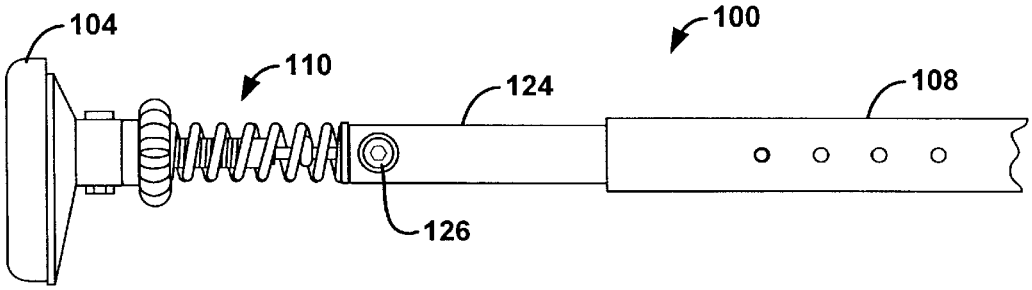
FIG. 2 is a view of a portion of the kicker of FIG. 1, with the connecting shaft in an extended position.
Figure 3:
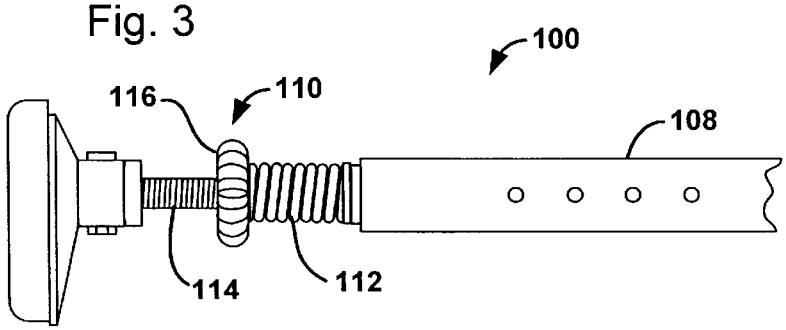
FIG. 3 is a view of a portion of the kicker of FIG. 1, with the adjustment knob of the compression spring in a fully compressed position.

Referring to FIGS. 1–3, an exemplary shock-absorbing kicker 100 according to the invention is shown. Kicker 100 may be configured similarly to conventional kickers in comprising the basic elements of an engaging head 140 connected to a cushioned striking pad 104 via a connecting shaft 108. Engaging head 140 may comprise forwardly-inclined pins 142, 144 for engaging carpet materials, and an adjustment knob 146 for adjusting the penetration depth of pins 142. Shaft 108 extends from the engaging head 140 and may be connected to head 140 via a suitable transition piece 148. Shaft 108 is preferably extendable, such as by being a telescoping tube that may be locked in selected positions by any suitable device, such as by a spring-loaded pin 121 that locks into a selected one of holes 120. Any other suitable shaft, bar, tube, or like elongated rigid member, or a plurality of such members in parallel, may be used instead of tubular shaft 108.

A shock-absorbing device 110 is connected to the shaft 108 and interposed between the cushioned striking pad 104 and the engaging head 140. The shock-absorbing device 110 is preferably connected to an end of the shaft 108 adjacent to the cushioned pad 104, but it should be apparent that the shock-absorbing device may be positioned anywhere between the cushioned pad and the engagement head. For example, the shock absorber 110 may be positioned ad the end of shaft 108 adjacent to the transition piece 148, or at an intermediate position along the shaft. When positioned as shown in FIGS. 1–3, the shock-absorbing device 110 may be connected to the cushioned striking pad 104 by adaptor bracket 106 and one or more fasteners, such as fastener 122.

Shock absorber 110 preferably includes an outer coil compression spring 112 disposed over a gas cylinder/piston assembly 114. Spring 112 is compressed between ends of the cylinder/piston assembly, maintaining the cylinder/piston 114 in preloaded tension when the kicker 100 is at rest. The compression of spring 112 is preferably adjustable by turning the ring-shaped adjustment knob 116, which is threaded onto the cylindrical outer surface of cylinder/piston assembly 114. Turning knob 116 causes it to advance along the cylinder, further compressing spring 112 between the ends of the cylinder/piston assembly. The shock-absorbing device 110 is discussed in more detail below.

FIG. 2 shows shaft 108 in a fully extended position. It is apparent that the extension of the shaft 108 may be designed to function independently of the shock absorbing unit 110. One or more fasteners, such as fastener 126, may be used to connect the shaft 108 to the shock absorbing unit 110. Fastener 126 is preferably flush with, or recessed below, the surface of internal shaft 124, so that shaft 124 may be fully inserted into the outer tube of shaft 108. In the alternative, or in addition, a suitable stop (not shown) may be connected to the internal tube 124 to prevent it from being fully inserted into the outer tube, and/or to prevent fastener 126 or shock absorber 110 from striking the outer tube in the event of a failure of the locking mechanism 120,121.

FIG. 3 shows the compression spring 112 adjusted to a fully compressed position. When fully compressed, adjacent coils of the compression spring are in contact with one another, and the coil spring is therefore referred to as "solid" or "solidified," meaning it cannot be compressed any further. When spring 112 is in the fully compressed position shown in FIG. 3, the shock-absorbing device 110 is essentially a rigid, incompressible member that behaves as if were a solid part of the shaft. It is therefore apparent that, in an embodiment of the invention, shock-absorber 110 may be adjusted so that kicker 100 performs like a conventional kicker, with essentially no additional shock-absorbing capability. At the other end of its adjustment range, at the position shown in FIGS. 1 and 2, the shock absorber 110 provides its maximum amount of compressibility and shock absorption. At this position, spring 110 may be essentially uncompressed, compressed a minimal amount, or compressed by a predetermined amount. Between these two positions, spring 112 may preferable compressed any desired amount by turning the ring-shaped knob 116 to the desired position.

Figure 4:
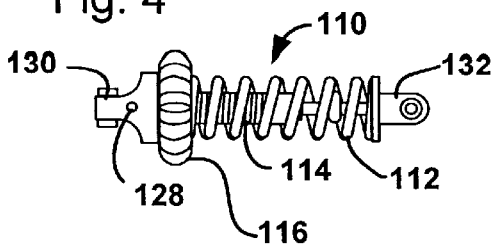
FIG. 4 is a side view of an exemplary modular shock-absorbing device for use with the invention.

Shock-absorbing device 110 is preferably a modular unit that may be removed from kicker 100 and readily replaced for purposes of repair or performance modification. FIG. 4 shows an exemplary modular shock-absorbing device 110 that may be connected to kicker 100 as shown in FIGS. 1–3, using the attachment arms 130, 132. A further advantage of a modular unit is that a mass-produced, stock device may be used, instead of a custom configuration, thus minimizing the additional cost of the shock absorber. For example, in an embodiment of the invention, it was found that a coil-over shock absorber designed and sold for use with off-road bicycles was suitable for use in kicker 100. One suitable shock absorber is the model TR-1 coil-over shock absorber available from Stratos Suspension Innovation OnSport, LLC, of Santa Barbara, Calif. (www.stratashock.com), but any other suitable modular unit may be used. In the alternative, but less preferably, the shock-absorbing device 110 may be integrated into other elements of kicker 100, such as into the shaft 108.

A further advantage of stock coil-over shock absorbers is that such devices incorporate an internal motion-damping gas cylinder that functions as a collapsible tension member. Such cylinders are advantageous in being relatively stable against lateral forces, and also in providing motion damping that may reduce backlash and vibration. In addition, the damping properties of the gas cylinder may be adjustable, such as by bleeding or supplying gas to the cylinder through a valve. An exemplary bleed/supply valve 128 is shown in FIG. 4. The damping gas cylinder preferably operates in a one-way damping mode, wherein most of the damping occurs during the backstroke of the cylinder. In the alternative, the gas cylinder may be configured to operate in a two-way damping mode, if additional damping is desired. It should be apparent that the gas cylinder 114 could be replaced by a different collapsible tension member, such as a flexible cable, but given the low cost and advantageous damping properties of stock shock absorbers with gas cylinders, there is little incentive to do so.

For adjustment of the compression spring 112, the outer cylindrical wall of the cylinder/piston assembly 1140 may be threaded with male threads. Ring-shaped knob 116 is provided with complementary female threads. Spring 112 is compressed between knob 116 and the base of arm 132. Knob 116 may be contoured for gripping by hand, and/or may be provided with suitable flats (not shown) so that it may be gripped and turned using a wrench. Turning knob 116 in a first direction advances it along the cylinder 114 and compresses spring 112 until the spring is maximally compressed. Turning in the opposite direction decompresses the spring until knob 116 is stopped by the base of arm 130. Any other suitable mechanism for adjusting the preload of spring 112 may be employed.

Figure 5:
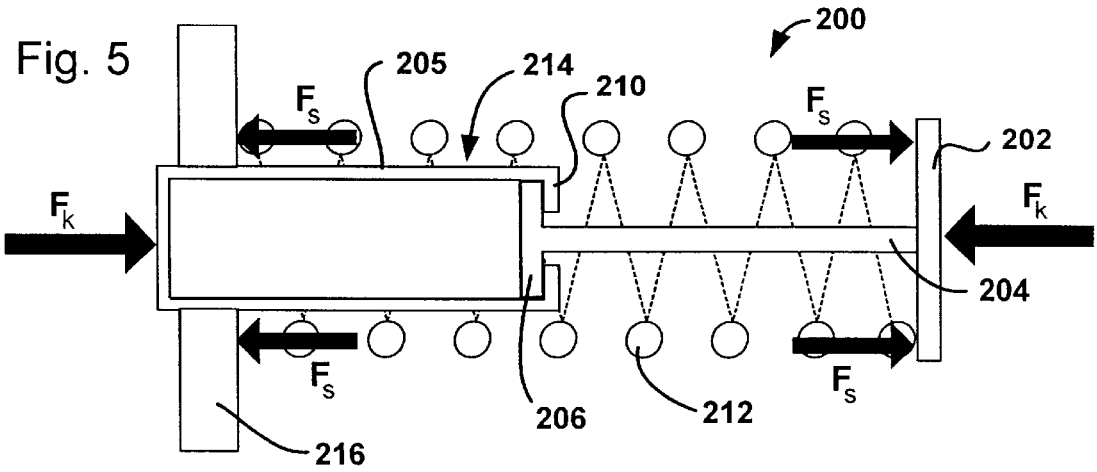
FIG. 5 is a schematic diagram showing a shock-absorbing device at the initiation of a kick, with the collapsible tension member under tension.
Figure 6:
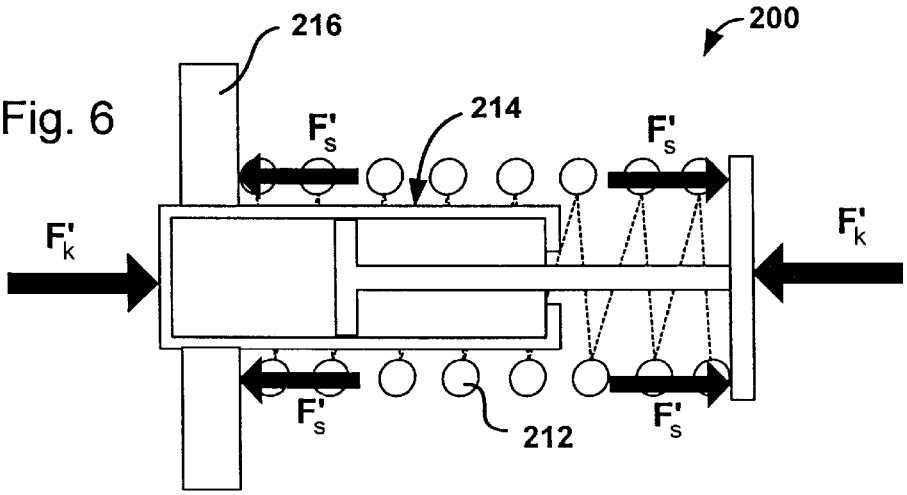
FIG. 6 is a diagram of the shock-absorbing device of FIG. 5, showing the device later in a kick, with the collapsible member collapsed.

FIGS. 5 and 6 are simplified diagrams showing an exemplary shock-absorbing device at different positions during use. FIG. 5 shows a device 200 at the initiation of a kick, with the collapsible tension member under tension. FIG. 6 shows the device 200 later in a kick, with the collapsible member partially collapsed. Forces imposed on the device by the kick are indicated by the arrows labeled $F_k$ in FIG. 5, and $F_k'$ in FIG. 6. Forces imposed on the device by the compression spring 212 are indicated by the arrows labeled $F_s$ in FIG. 5, and $F_s'$ in FIG. 6.

FIG. 5 shows a collapsible tension member 214, comprising a cylinder 205 and piston 206, in a fully extended position by the preload forces imposed by spring 212. In the fully extended position, piston 206 is stopped by end wall 210, and both cylinder 205 and shaft 204 are in tension. The tensile force on the cylinder and shaft, making the simplifying assumption that device 200 is statically balanced, is evidently equal to $F_s$–$F_k$. At the initiation of the kick, the kicking force is less than the compressive preload on the spring, so the collapsible member 214 remains in tension.

By definition, the collapsible member 214 is relatively rigid in tension, meaning that it elongates relatively little under the influence of a tensile force "T," once it is in its fully extended position. Therefore, when fully extended it may be considered to have an elongation constant (spring constant) defined as $k_m=T/\Delta$, where $\Delta$ is the amount of elongation under a force T. Similarly, spring 212 may be regarded as having a spring constant $k_s=F/c$, where c is the amount of linear compression under a compressive force F. Because the spring 212 is compressed between ends of the collapsible member 214 so long as the collapsible member is maintained in tension, the deflection of the spring under the external kicking force is equal to the deflection of the collapsible member at the initiation of a kick. Setting these two deflections equal and substituting the above expressions for $k_m$ and $k_s$ leads to the expression $$T = \frac{k_m}{k_m + k_s} F_k + F_{s0} \tag{1}$$

where $F_{s0}$ is the preload force imposed by the spring 212 (i.e., the compressive force imposed by spring 212 in the absence of any external force). It should be noted that $F_{s0}$ and $F_k$ operate in opposite directions, and therefore have opposite signs. When T=0, the collapsible member is no longer in tension and begins to collapse. Setting T=0 in equation (1) yields the relation $$F_{k0} = -\frac{k_m + k_s}{k_m} F_{s0} \tag{2}$$

where $F_{k0}$ is the kicking force at the point of collapse. Preferably, $k_m$ is much greater that $k_s$, such as about ten or more times greater, so that the quantity $k_m+k_s/k_m$ is approximately equal to (i.e., slightly greater than) one. Accordingly, the kicking force at the point of collapse ($F_{k0}$) is slightly greater than the compressive preload of spring 212 ($F_{s0}$). More importantly, prior to collapse of member 214, because of the stiffness of member 214 relative to spring 212, essentially all of the kicking force will be transmitted through the shock-absorbing device with little noticeable deflection. That is, the device 200 will respond essentially like a rigid member until the kicking force exceeds the preload force exerted by the spring.

Therefore, a kicker that employs the device 200 will advantageously transmit the initial kicking force to the carpet, as though it were a conventional kicker. At the same time, it is not necessary to use a relatively stiff spring to achieve adequate energy transmission through the kicker an to the carpet, because even a relatively soft spring can be made to transmit the initial energy of the kick by preloading against a collapsible tension member. Thus, the response of the kicker can be made initially stiffer than prior-art shock-absorbing kickers, and yet after collapse of member 214, the response can be as soft or softer than prior-art shock-absorbing kickers, for absorbing excess energy of the kick.

During its collapse as shown in FIG. 6, member 214 is essentially incapable of carrying compressive forces (except for a relatively small amount as may arise from internal friction and fluid damping forces). Therefore, essentially all of the compressive force of the kick is carried by the spring 212 after member 214 collapses. At the same time, the magnitude of the force transmitted by device 200 increases. That is, $F_k'$ shown in FIG. 6 is greater than $F_k$ shown in FIG. 5. Fs' is accordingly also greater than Fs, but more importantly, any increase in the spring force after collapse of member 214 corresponds to a linear increase in the deflection of the spring 212. Because of the relatively low spring constant of spring 212, the amount of deflection may be substantial, and hence, much of the excess energy of the kick will be absorbed by the spring.

If too much energy is being absorbed by the spring, making use of the kicker more energy-intensive than necessary, the user may remedy the situation by adjusting knob 216 to increase the preload of spring 212. Likewise, if the device 200 is responding too stiffly, it may be made more energy-absorbent by decreasing the initial preload of the spring. Accordingly, another great advantage of a kicker 100 according to the invention is that the response of the kicker is readily adjusted by the user, by changing the preload of spring 212.

Alternative Shock Absorbing Devices

The invention is not limited to kickers that incorporate a shock-absorber as shown in FIGS. 1–4, and may include any kicker with a shock-absorbing device comprising a resilient member compressed against a collapsible tension member. In practice, such a device may be constructed in a variety of ways, exemplified as follows.

Figure 7:
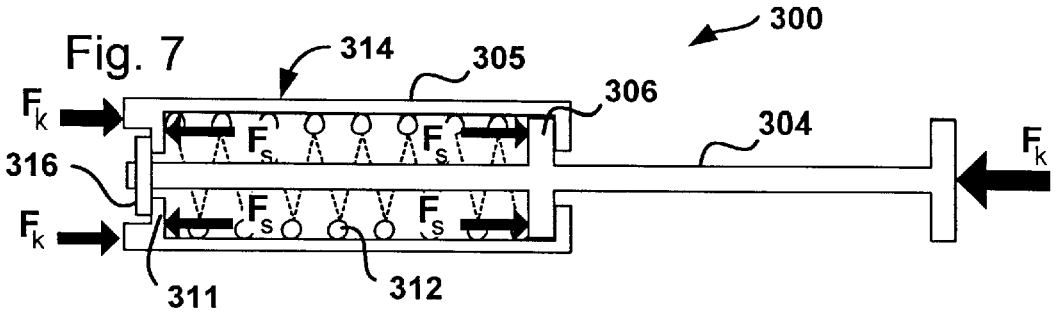
FIG. 7 is a diagram showing an alternative embodiment of a shock-absorbing device for use with the invention, utilizing an internal adjustable compression spring.

For example, the invention is not limited to the use with an outer, coil-over compression spring. In the alternative, but less preferably, a compression spring may be located internal to a housing of the shock-absorbing device, as shown in FIG. 7. In this alternative embodiment, shock absorbing device 300 comprises an adjustable compression spring 312 internal to a cylinder housing 305 of collapsible member 314. Kicking forces $F_k$ and the internal force of the spring $F_s$ are as indicated by the arrows. Shaft 304 passes through an opposite end 311 of cylinder 305, and is connected to a plunger that rests against an end of the compression spring 312. Shaft 304 is threaded in the vicinity of end 311. Adjustment nut 316 is threaded onto shaft 304 outside of end 311. As shown, the device 300 is in a minimum preload position. Turning the adjustment screw in the proper direction will pull the plunger towards the end 311 when the kicker is at rest, thereby compressing the spring 312 and increasing the preloaded tension on the collapsible member 314.

Figure 8:
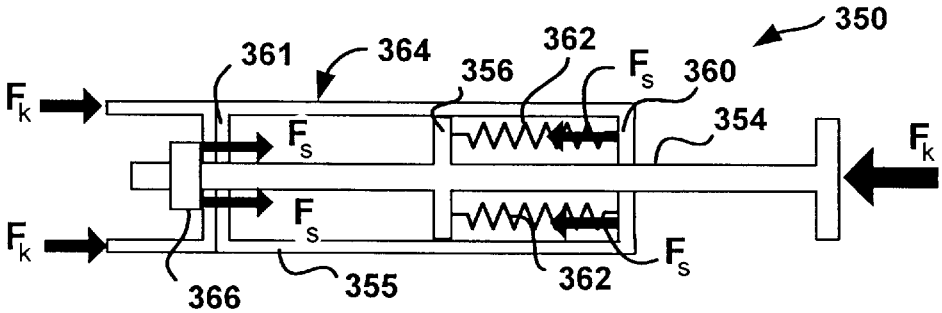
FIG. 8 is a diagram showing an alternative embodiment of a shock-absorbing device for use with the invention, utilizing an adjustable tension spring.

It is further possible to use an tension spring instead of a compression spring, as shown in FIG. 8, showing a diagram of an alternative shock absorber 350. Shock absorber 350 is similar to shock absorber 300 shown in FIG. 7, but the collapsible member 364 is reconfigured so that one or more tension springs 362 are disposed between the plunger 356 of shaft 354 and end wall 360 of cylinder 355. Kicking forces $F_k$ and the internal force of the spring $F_s$ are as indicated by the arrows; i.e., the kicking forces tend to compress the collapsible member 364, and are resisted by the internal tensile force exerted by springs 362. Shaft 354 passes through the wall 361 of cylinder 355, and is threaded into an adjustment nut 366. Turning nut 366 in the proper direction advances the shaft 354 and plunger 356 towards wall 361, increasing tension in springs 362 and the preload in the collapsible member 364. In shock absorber 350, the cylinder 355 is compressed by the preload of the tension springs, while the portion of the shaft 354 between the adjustment nut 366 and plunger 356 is under tension. Despite differences in detail, beneficial preload is present in both devices 300 and 350, and functions in essentially the same way.

The foregoing examples serve to illustrate various exemplary structures for a shock-absorbing device for use with the invention. In each example, the essential structure of a resilient member preloaded against a collapsible tension member is present, whereby a kicking force may be transmitted through the shock-absorbing device.

Model of Shock-Absorbing Kicker and Carpet System

Figure 9:
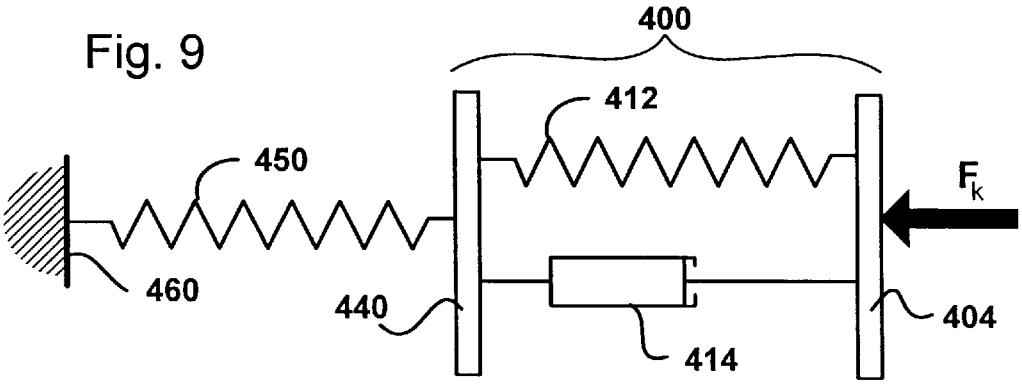
FIG. 9 is a schematic diagram showing a conceptual model of system, made up of a shock-absorbing carpet kicker according to invention connected to a piece of carpeting.

Carpet kickers are, of course, used to move and stretch carpet, and thus the interaction between the kicker and the moving carpet should be a consideration in designing a shock-absorbing kicker. While the invention is not limited by any conceptual or theoretical model that might explain its operation, a model may nevertheless be useful in understanding potential benefits provided by a kicker according to the invention. FIG. 9 shows a diagram of an exemplary conceptual model of system, made up of a shock-absorbing carpet kicker 400 according to invention connected to a piece of carpeting 450.

The piece of carpeting 450 is anchored to a rigid substrate, such as floor 460, and one end. A second end of the carpeting 450 is attached to carpet kicker 400 by engaging head 440. A shock absorbing device, comprised of spring 412 preloaded against collapsible tension member 414, is interposed between the engaging head and the cushioned striking pad 404. A kicking force is applied to the striking pad 404 in the direction shown by arrow $F_k$. Although in practice the carpet 450 would be anchored to floor 460 behind the kicker 400, for illustrative clarity the anchor point is shown in front of the kicker. It should be appreciated, however, that the carpet 450 is stretched by the kicking force $F_k$, and is not compressed as might appear from the diagram of FIG. 9.

It should also be appreciated that while both may be modeled conceptually as springs, the characteristics of the spring 412 and the carpet 450 are dramatically different. Spring 412 is preferably a mechanical spring, such as a coil spring, specifically designed to have a known spring constant that is linear over a substantially large range. For example, the linear range of spring 412 may be as large as several inches, or greater. In contrast, the carpet 450 is essential a piece of textile material for which spring characteristics are incidental or secondary. Typically, carpet will not respond in a linear fashion to an applied stretching force, except perhaps over a relatively short range. Instead, the force required to stretch carpet becomes disproportionately greater as the carpet is stretched. For example, if a 500-pound force stretches a ten-foot piece of carpet two inches, a 1000-pound force will typically not result in four inches of stretch. Instead, the 1000-pound force might result (for example) in two-and-a-half or three inches of stretch. That is, as the stretching force is increased, the relative amount of stretch achieved will diminish non-linearly. And as the amount of stretch diminishes, the amount of energy absorbed by the carpet also diminishes, and excess energy will be absorbed instead by some other compliant element of the system.

Therefore, when stretching carpet, excessive force is essentially wasted, performs little or no useful work, and may fatigue or injure the user of a conventional kicker. At the same time, when using a kicker it is difficult for an installer to modulate the kicker force so as to apply the correct amount of force. One reason is that the spring characteristics of a particular piece of carpet are inherently unpredictable, and may vary considerably in different circumstances. Another reason is that kicking a kicker is by nature a very brief, transient operation during which the carpet is not only stretched, but also positioned and set onto a tack strip. These secondary operations require additional cycle time, that a harder kick may provide. For these reasons, users may tend to overpower their kicks, generating excess energy that is absorbed elsewhere than in the carpet itself.

Results of overpowering a conventional kicker may be understood based on a conceptual model of a kicker as an essentially rigid member. In other words, referring to FIG. 9, the spring 412 and collapsible member 414 are replaced by a rigid member, while the other elements remain as previously described. The only resilient element in this system is therefore the carpet 450. When a conventional kicker is overpowered (i.e., delivered a kick that is more forceful than necessary), the maximum power absorbed by the carpet will occur at some time earlier than the point of maximum force, corresponding to an optimal transmitted force. Power absorbed by the carpet will drop off rapidly as the kicking force exceeds the optimal force, because the carpet will stretch relatively little after the optimal force is delivered, becoming essentially a rigid element. Therefore, with a conventional kicker, much of the energy of the kick delivered after the optimal force is achieved can not absorbed by the carpet or by the rigid kicker, and is wasted or dissipated instead in some harmful fashion.

In comparison, prior-art shock-absorbing kickers employ a resilient element interposed between the engaging head and the striking pad, but do not preload the resilient member and employ no collapsible tension member. To model this conceptually, the spring 412 and collapsible member 414 of FIG. 9 may be replaced by a single resilient element (spring), while the other elements remain as previously described. Now if the prior-art shock-absorbing kicker is kicked as described in the foregoing paragraph, assuming that the carpet initially has a lower k-value (force per unit stretch) than the spring in the kicker, the force transmitted by the kicker will be similar to that transmitted by a conventional kicker for only a brief duration. As the carpet stretches, its k-value increases, and at a relatively early time "$t_0$" in the kicking stroke, will exceed the k-value of the kicker spring. Accordingly, after this point, the kicking force primarily deflects the spring in the kicker instead of stretching the carpet. At the same time, the deflection of the spring lengthens the distance and duration of the kicking stroke at the striking pad of the kicker, and thereby tends to lessen the peak force transmitted by the kicker. Power to the carpet may therefore be greatly diminished relative to a conventional kicker, because of the slower increase in force transmitted by the kicker and the relatively large amount of energy absorbed by the kicker spring after $t_0$. Also, the maximum force transmitted by the kicker will be less than the maximum force of a conventional kicker, and may even be less than the optimal force delivered by the conventional kicker early in the kicking stroke. Consequently, the shock-absorbing kicker will stretch the carpet more slowly than the conventional kicker (which may leave the user with relatively less time for positioning and setting the carpet), and not as far. Simply put, too much of the energy of the kicking stroke will go into deflecting the kicker spring, and not enough into stretching the carpet.

The shock-absorbing kicker according to the invention overcomes these disadvantages of prior-art conventional and shock-absorbing kickers. By setting spring 412 with an optimal preload, the kicker will respond like a conventional kicker until the optimal force and peak power has been delivered to the carpet. At this point, the collapsible member will collapse and most of the remaining energy of the kick will be absorbed by the shock-absorbing device. The peak force of the kick can be accordingly diminished, and the duration of the kicking stroke can be increased, without adversely affecting the amount of stretch imparted to the carpet or the time required to stretch the carpet. Furthermore, once the pre-load is properly set, the user knows to attenuate the kicking force after feeling the collapsible member collapse, because at the point of collapse, optimal force and power has been delivered to the carpet. Unnecessary effort by the user as well as excessive shock can thereby be avoided, further increasing the benefits of using a kicker according to the invention, as compared to prior-art shock absorbing kickers.

Engaging Head and Striking Pad

In general, any suitable cushioned striking pad may be used with a carpet kicker according to the invention. Various striking pads are known in the art, and generally comprise a relatively firm foam rubber cushion supported by a back plate. The purpose of the cushion is to provide cushioning for the user's knee, and not to absorb substantial energy from the kicking stroke. If the cushioned pad is made too soft, it will compress too much during the kicking stroke, making the kicker difficult to use. An overly soft cushion will also be less durable than a firm cushion, and may degrade rapidly during use. The pad is preferably just soft enough to cushion the immediate impact area of the user's knee, and no softer, thereby preventing the pain and discomfort of striking a hard surface with the knee without absorbing too much energy from the kicking stroke.

Figure 10:
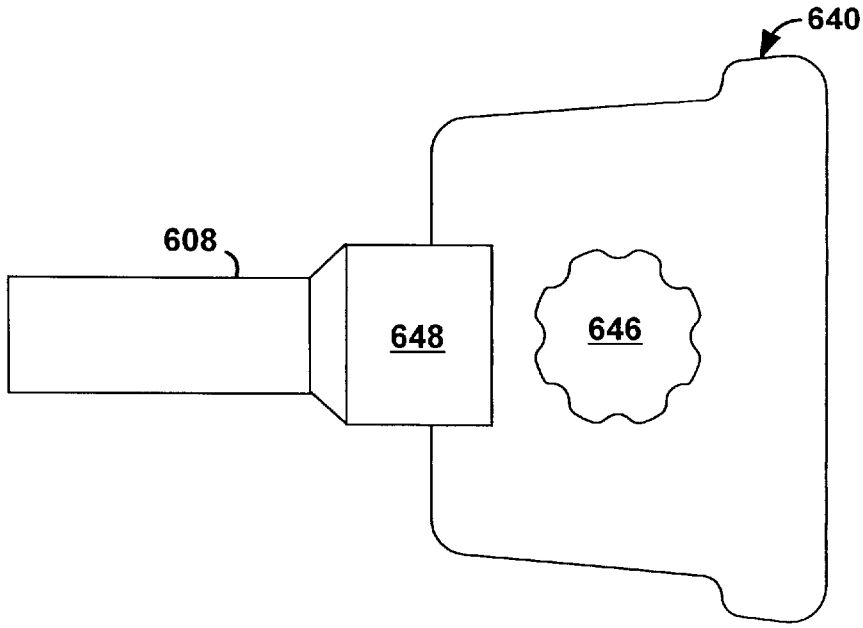
FIG. 10 is a top view of an engaging head for use with the shock-absorbing kicker.
Figure 11:
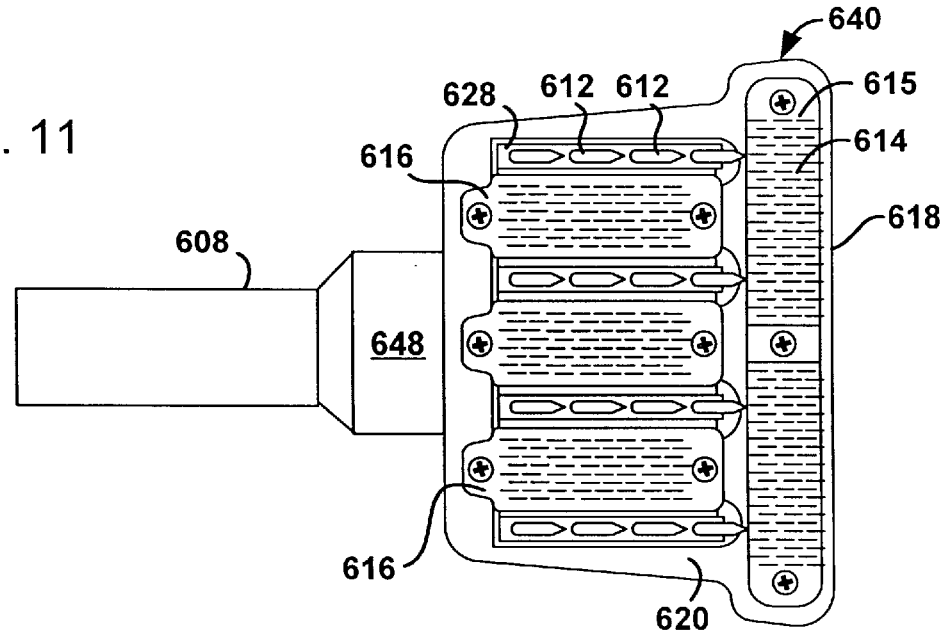
FIG. 11 is a bottom (carpet-side) view of an engaging head for use with the shock-absorbing kicker.

Any suitable engaging head may be used with a kicker according to the invention, and various different types of engaging heads are known in the art. FIGS. 10 and 11 show one exemplary engaging head 640 for use with the shock-absorbing kicker of the invention.

Engaging head 640 is connected to shaft 608 via a transition piece 648. An upper face of the engaging head 640 is provided with an adjustment knob 646 for adjusting the amount by which pin teeth 612 protrude from the carpet side 620 of the engaging head. The pin teeth are relatively large pointed teeth designed to penetrate into the carpet backing, and are mounted to a plate 628 connected to knob 646 via an adjustment mechanism (not shown). Rows of cotton-heads 616, having numerous relatively fine teeth 614 designed to engage carpet tufts without penetrating into the carpet backing, are interspersed between the rows of pin teeth. The pin-teeth 612 and cotton-head teeth 614 are forwardly inclined, i.e., inclined towards the leading edge 618 of engagement head 640. A leading cotton-head 615 is preferably mounted adjacent to leading edge 618 and transverse to trailing cotton-heads 616. Engaging head 640 is suitable for firmly engaging a wide variety of different carpet materials.

Having thus described a preferred embodiment of a shock-absorbing carpet kicker, it should be apparent to those skilled in the art that certain advantages of the within system have been achieved. It should also be appreciated that various modifications, adaptations, and alternative embodiments thereof may be made within the scope and spirit of the present invention. For example, a carpet kicker utilizing a modular coil-spring and gas cylinder shock absorber has been illustrated, but it should be apparent that the inventive concepts described above would be equally applicable to many other types of shock absorbers configured according to the inventive concepts of the invention, in combination with a carpet kicker. In particular, many different types of resilient members may be substituted for the coil spring, and many different types of collapsible tension members may be substituted for the gas cylinder, without departing from the scope of the invention, as exemplified by the alternative shock-absorbing devices described herein. The invention is further defined by the following claims.

What is claimed is:

1. An apparatus for positioning carpet, comprising, an engaging head with forwardly-inclined pins for engaging carpet materials on a floor;

a shaft connected to the engaging head and extending therefrom;

a cushioned pad facing away from the engaging head and connected to the shaft a distance away from the engaging head; and a shock-absorbing device connected to the shaft and interposed between the engaging head and the cushioned pad, the shock absorbing device comprising a resilient member preloaded against a collapsible tension member, whereby kicks to the cushioned pad are transmitted through the shock-absorbing device to the engaging head, wherein the collapsible tension member is operatively associated with a cylinder configured to dampen extension of the collapsible tension member.

2. The apparatus of claim 1, wherein the shock-absorbing device is a modular unit removably connected to the apparatus.

3. The apparatus of claim 1, wherein the resilient member is preloaded by an adjustable amount.

4. The apparatus of claim 1, wherein the shock-absorbing device further comprises a mechanism for adjusting the compression of the resilient member.

5. The apparatus of claim 1, wherein the shock-absorbing device further comprises a coil compression spring compressed against opposing ends of the collapsible tension member.

6. The apparatus of claim 5, further comprising means for adjusting an amount of compression of the coil compression spring.

7. The apparatus of claim 5, wherein the collapsible tension member comprises a cylinder/piston assembly.

8. The apparatus of claim 7, wherein the coil compression spring is disposed over and outside of the cylinder/piston assembly.

9. The apparatus of claim 8, wherein the shock-absorbing device further comprises an adjustment knob disposed against the compression spring.

10. The apparatus of claim 9, wherein the adjustment knob is threaded onto the outside of the cylinder/piston assembly.

11. The apparatus of claim 1, wherein the cylinder further comprises a motion-damping gas cylinder.

12. The apparatus of claim 11, wherein the motion-damping gas cylinder is configured for two-way damping.

13. The apparatus of claim 11, further comprising a valve in series with a port of the motion-damping gas cylinder.

14. The apparatus of claim 1, wherein the shaft is extendable.

15. The apparatus of claim 1, wherein the shaft is a telescoping tubular member.

16. An apparatus for positioning carpet, comprising, an engaging head with forwardly-inclined pins for engaging carpet materials on a floor;

a shaft connected to the engaging head and extending therefrom;

a cushioned pad facing away from the engaging head and connected to the shaft a distance away from the engaging head;

a collapsible tension member connected to the shaft and interposed between the engaging head and the cushioned pad, wherein the collapsible tension member comprises a cylinder configured to dampen a return stroke of the collapsible tension member; and a coil compression spring disposed around an exterior of the collapsible tension member and compressed between opposite ends of the collapsible tension member.

17. The apparatus of claim 16, wherein the coil compression spring and the collapsible tension member are part of a modular unit removably connected to the apparatus.

18. The apparatus of claim 16, further comprising a mechanism for adjusting the compression of the coil compression spring.

19. The apparatus of claim 16, wherein the mechanism is adjustable between a first position in which the coil compression spring is compressed a maximum amount, and a second position in which the coil compression spring is compressed a minimum amount greater than zero.

20. The apparatus of claim 16, wherein the cylinder comprises a cylinder/piston assembly.

* * * * *